US007686435B2

(12) United States Patent
Gao et al.

(10) Patent No.: US 7,686,435 B2
(45) Date of Patent: Mar. 30, 2010

(54) ACOUSTIC FLUID FLOW DEVICE FOR PRINTING SYSTEM

(75) Inventors: Zhanjun Gao, Rochester, NY (US); Jinquan Xu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 389 days.

(21) Appl. No.: 11/770,786

(22) Filed: Jun. 29, 2007

(65) Prior Publication Data

US 2009/0002446 A1 Jan. 1, 2009

(51) Int. Cl.
*B41J 2/09* (2006.01)
*B41J 2/105* (2006.01)

(52) U.S. Cl. ..... 347/77; 347/82

(58) Field of Classification Search ..... 347/77, 347/82, 73, 74, 75
See application file for complete search history.

(56) References Cited

U.S. PATENT DOCUMENTS 4,005,435 A * 1/1977 Lundquist et al. ..... 347/75
4,068,241 A 1/1978 Yamada
4,074,277 A * 2/1978 Lane et al. ..... 347/75
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,863,385 B2 * 3/2005 Jeanmarie et al. ..... 347/77

OTHER PUBLICATIONS

U.S. Appl. No. 11/746,117, filed May 9, 2007, Xu et al.
U.S. Appl. No. 11/746,104, filed May 9, 2007, Xu et al.
U.S. Appl. No. 11/746,094, filed May 9, 2007, Xu et al.

* cited by examiner

*Primary Examiner*—K. Feggins
(74) *Attorney, Agent, or Firm*—William R. Zimmerli

(57) ABSTRACT

A printing system includes a liquid drop ejector, a fluid passage, and a fluid flow source. The liquid drop ejector is operable to form liquid drops having a plurality of volumes moving along a first path. The fluid passage includes a wall. A source of acoustic energy is associated with the wall. A fluid flow source is associated with the passage and is configured to provide a fluid flow through the passage. Interaction of the fluid flow and the liquid drops causes liquids drops having one of the plurality of volumes to begin moving along a second path.

14 Claims, 5 Drawing Sheets

ACOUSTIC FLUID FLOW DEVICE FOR PRINTING SYSTEM

CROSS REFERENCE TO RELATED APPLICATIONS

Reference is made to commonly-assigned, U.S. patent application Ser. No. 11/770,774, filed currently herewith, entitled "ENERGY DAMPING FLOW DEVICE FOR PRINTING SYSTEM," and U.S. patent application Ser. No. 11/770,804, filed currently herewith, entitled "PERFORATED FLUID FLOW DEVICE FOR PRINTING SYSTEM."

FIELD OF THE INVENTION

This invention relates generally to the management of fluid flow and, in particular to the management of fluid flow in printing systems.

BACKGROUND OF THE INVENTION

Printing systems that deflect drops using a gas flow are known, see, for example, U.S. Pat. No. 4,068,241, issued to Yamada, on Jan. 10, 1978.

The device that provides gas flow to the gas flow drop interaction area can introduce turbulence in the gas flow that may augment and ultimately interfere with accurate drop deflection or divergence. Turbulent flow introduced from the gas supply typically increases or grows as the gas flow moves through the structure or plenum used to carry the gas flow to the gas flow drop interaction area of the printing system.

Drop deflection or divergence can be affected when turbulence, the randomly fluctuating motion of a fluid, is present in, for example, the interaction area of the drops (traveling along a path) and the gas flow force. The effect of turbulence on the drops can vary depending on the size of the drops. For example, when relatively small volume drops are caused to deflect or diverge from the path by the gas flow force, turbulence can randomly disorient small volume drops resulting in reduced drop deflection or divergence accuracy which, in turn, can lead to reduced drop placement accuracy.

Accordingly, a need exists to reduce turbulent gas flow in the gas flow drop interaction area of a printing system.

SUMMARY OF THE INVENTION

According to one aspect of the present invention, a printing system includes a liquid drop ejector, a fluid passage, and a fluid flow source. The liquid drop ejector is operable to form liquid drops having a plurality of volumes moving along a first path. The fluid passage includes a wall. A source of acoustic energy is associated with the wall. A fluid flow source is associated with the passage and is configured to provide a fluid flow through the passage. Interaction of the fluid flow and the liquid drops causes liquids drops having one of the plurality of volumes to begin moving along a second path.

According to another aspect of the present invention, a method of printing includes forming liquid drops having a plurality of volumes moving along a first path using a liquid drop ejector; causing a fluid to flow through the fluid passage using a fluid flow source associated with the passage; and providing acoustic energy to the fluid flow using a source of acoustic energy associated with a wall of the fluid passage, wherein interaction of the fluid flow and the liquid drops causes liquids drops having one of the plurality of volumes to begin moving along a second path.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
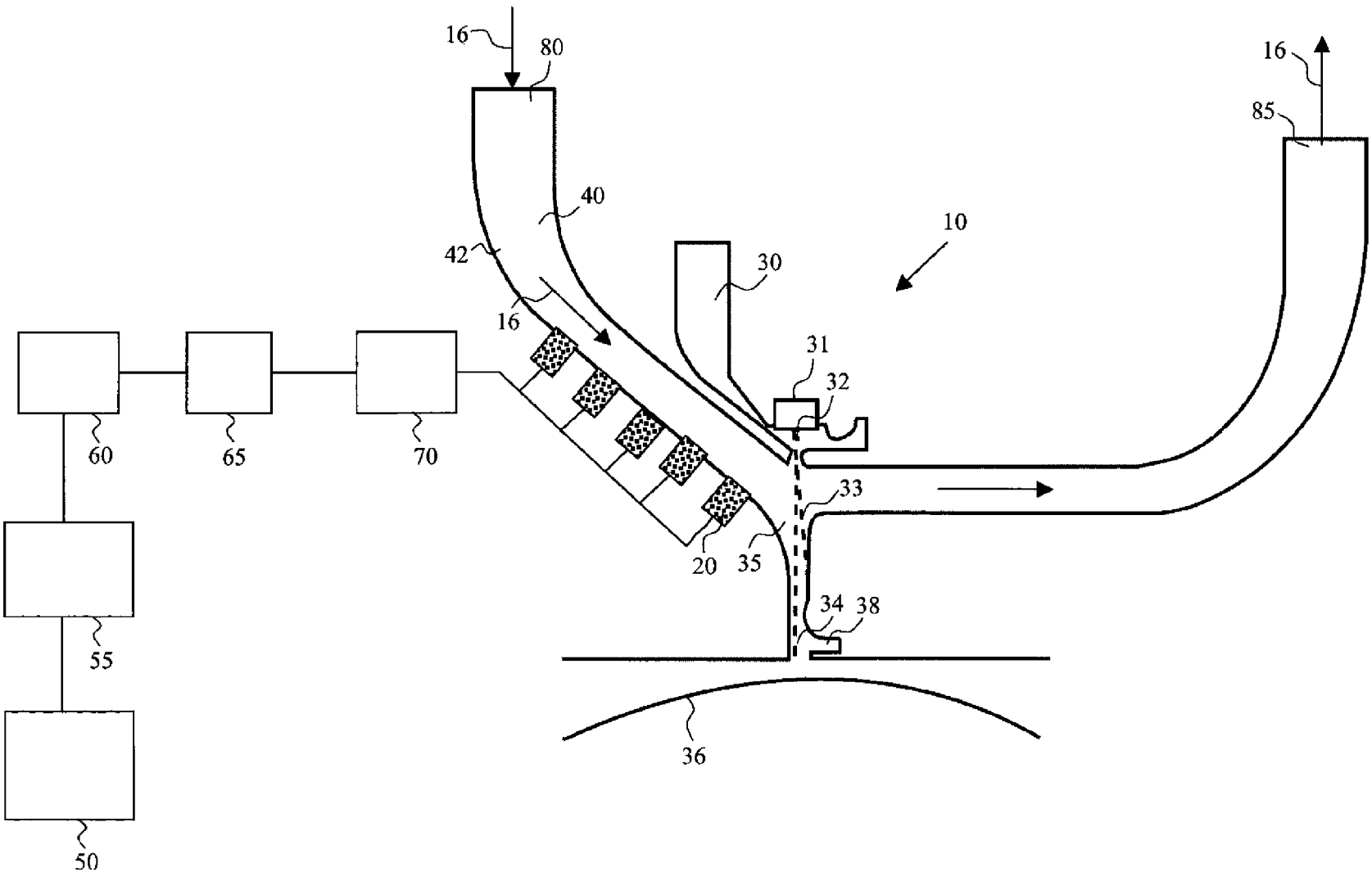
FIG. 1 is a schematic side view of a printing system incorporating an example embodiment of an acoustic energy source of the present invention.

The present description will be directed in particular to elements forming part of, or cooperating more directly with, apparatus in accordance with the present invention. It is to be understood that elements not specifically shown or described may take various forms well known to those skilled in the art.

The example embodiments of the present invention are illustrated schematically and not to scale for the sake of clarity. One of ordinary skill in the art will be able to readily determine the specific size and interconnections of the elements of the example embodiments of the present invention. In the following description, identical reference numerals have been used, where possible, to designate identical elements.

Although the term printing system is used herein, it is recognized that printing systems are being used today to eject other types of liquids and not just ink. For example, the ejection of various fluids such as medicines, inks, pigments, dyes, and other materials is possible today using printing systems. As such, the term printing system is not intended to be limited to just systems that eject ink.

Referring to FIG. 1, a schematic view of a printing system 10 incorporating an example embodiment of an acoustic energy source 20 is shown. Printing system 10 includes a liquid drop ejector or printhead 30 positioned to eject drops 32 through passage 35. At least some the drops 32 contact a receiver 36 while other drops are collected by a catcher 38.

A fluid flow 16 is provided through fluid passage 40 with wall 42. Acoustic energy sources 20 are attached on wall 42. With power supply 50, an acoustic sound generator 55 produces a broad spectrum of frequencies of sound that are feed into band filter 60 to filter out unwanted frequencies. The signal is then passed through amplifier 65, a sound level gauge 70, and sent to plurality of acoustic energy sources 20.

Printhead 30 includes a drop forming mechanism 31 operable to form drops 32 having a plurality of volumes traveling along a first path. The fluid flow 16 is applied in a direction such that drops having one of the plurality of volumes diverge (or deflect) from the first path (not shown in FIG. 1) and begin traveling along a second path 33 while drops having another of the plurality of volumes remain traveling substantially along the first path or diverge (deflect) slightly and begin traveling along a third path 34. Receiver 36 is positioned along one of the first, second, and third paths while catcher 38 is positioned along another of the first, second and third paths depending on the specific application contemplated. Printheads like printhead 30 are known and have been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; and U.S. Pat. No. 6,588,888 B2, issued to Jeanmaire et al., on Jul. 8, 2003.

After being ejected by the drop forming mechanism of printhead 30, drops 32 travel along the first path which is substantially perpendicular to printhead 30. Acoustic energy source 20 is attached to wall 42 of the first passage 40 of fluid flow. A fluid flow source 16 is operatively associated with one or both of the inlet portion 80 and the outlet portion 85. For example, pressurized gas (e.g. air) from a pump can be introduced in the inlet portion 80 and/or a vacuum (negative air pressure relative to ambient operating conditions) from a vacuum pump can be introduced in the outlet portion 85. When fluid flow sources like these are introduced on the inlet portion 80 and the outlet portion 85 a sink for the fluid or gas flow is provided. The fluid or gas flow (represented by arrows 16) of the drop deflector interacts with ejected drops 32 and causes drops 32 to diverge or deflect as described above. The amount of deflection is volume dependent with smaller volume drops being deflected by the fluid or gas flow more than larger volume drops. The acoustic energy source 20 attached to wall 42 incorporates mechanisms to supply acoustic wave into the boundary layer that provides damping effect to the turbulence. In other words, the acoustic energy interferes with the boundary layer and leads to laminar-turbulent transition delay. The specific range of desired frequencies is dependent upon a number of variable factors including the rate of fluid flow, passage size, etc. In general, however, it is sufficient that the frequencies produced by acoustic energy source 20 be at least twice as high as the as Tollmien-Schlichting waves, the airflow disturbances within a range of predictable oscillatory frequencies.

Figure 2:
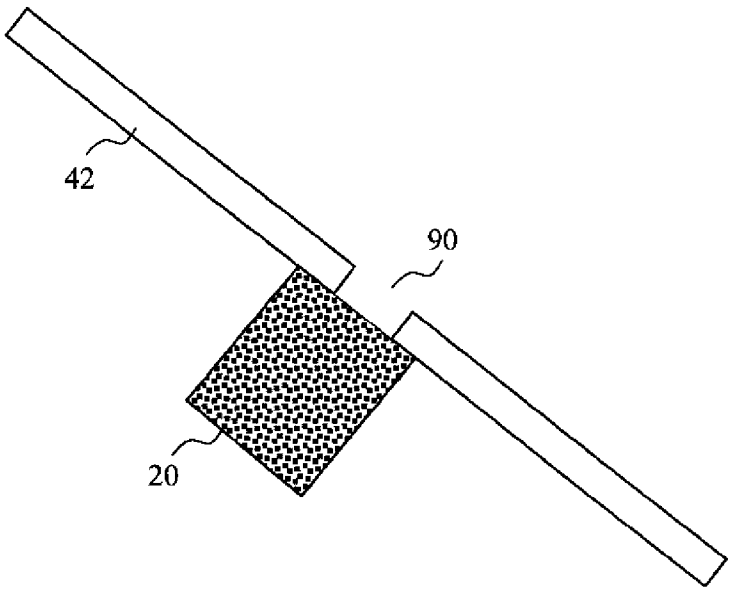
FIG. 2 is a schematic side view of an example embodiment of an acoustic energy source with a wall containing an opening.

An example embodiment of wall 42 of first passage 40 and acoustic energy source 20 shown in FIG. 2. In this embodiment, wall 42 contains opening 90 where acoustic energy source 20 is mounted. Such an arrangement facilitates the propagation of the acoustic energy into first passage 40. A typical shape of opening 90 is circular, elliptical. Other shapes include square and rectangle. Plurality of openings 90 may exist for one acoustic energy source 20.

Figure 3:
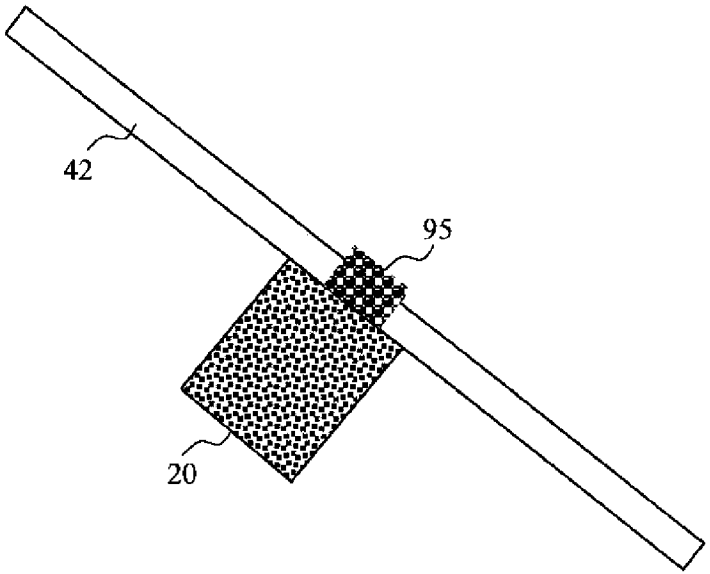
FIG. 3 is a schematic side view of another example embodiment of an acoustic energy source with a wall containing porous section.

Another example embodiment of wall 42 of first passage 40 and acoustic energy source 20 is shown in FIG. 3. In this embodiment, wall 42 contains porous section 95 where acoustic energy source 20 is mounted. Such an arrangement facilitates the propagation of the acoustic energy into first passage 40. A typical shape of porous section 95 is circular, elliptical. Other shapes include square and rectangle. Plurality of porous sections 95 may exist for one acoustic energy source 20.

Figure 4:
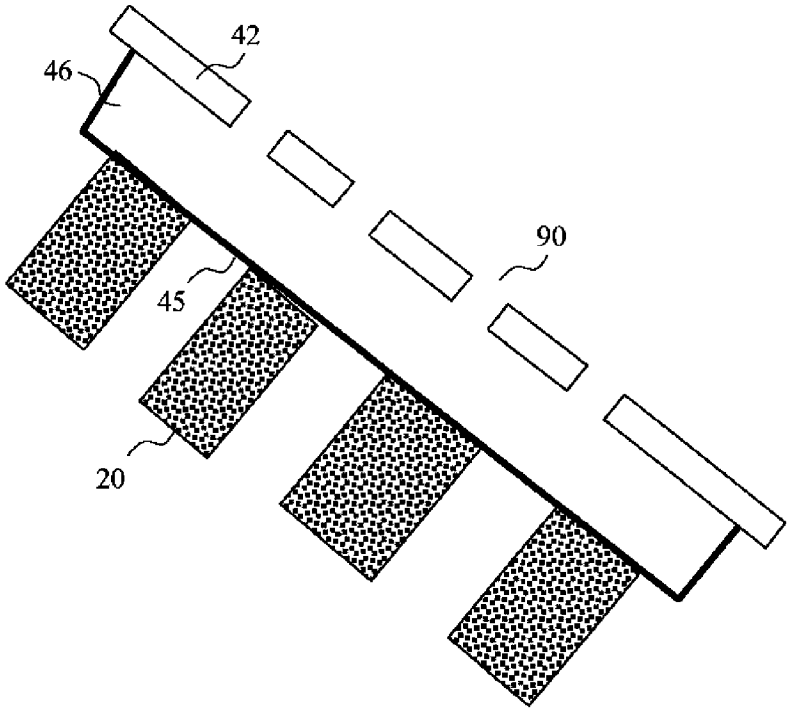
FIG. 4 is a schematic side view of yet another example embodiment of an acoustic energy source with a secondary wall and a first wall containing an opening.

Yet another example embodiment of wall 42 of first passage 40 and acoustic energy source 20 is shown in FIG. 4, where acoustic energy source 20 is not in direct contact with wall 42. Instead, secondary wall 45 exists on which plurality acoustic energy sources 20 are mounted. Wall 40 consists plurality of openings 90. Space 46 between wall 42 and secondary wall 45 can be at ambient air pressure. It can also be kept to have an air pressure lower or higher than that of passage 40. When the pressure in space 46 is higher than that in passage 40, air will enter into passage 40 from space 46. When the pressure in space 46 is lower than that in passage 40, air will leak into space 46 from passage 40.

Figure 5:
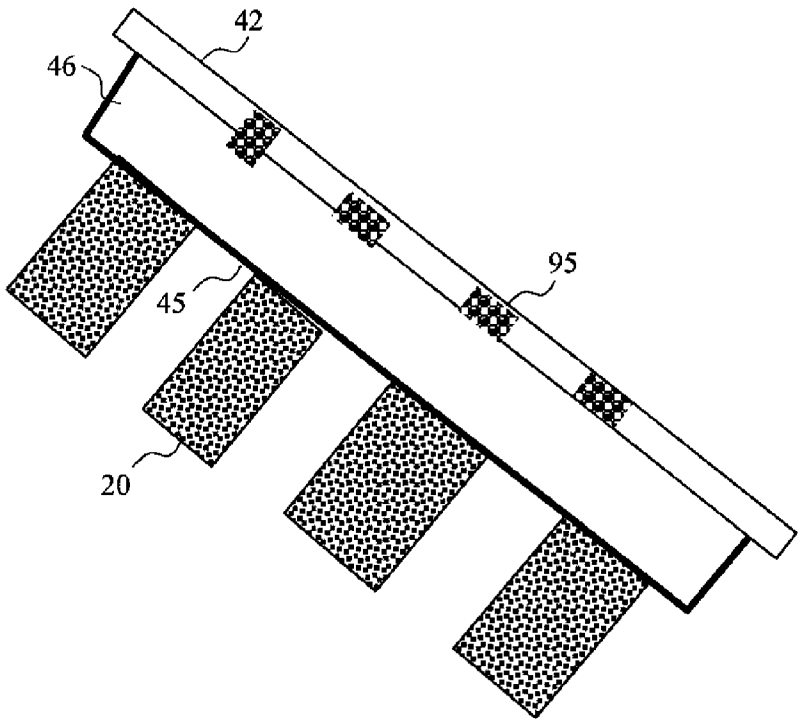
FIG. 5 is a schematic side view of yet another example embodiment of an acoustic energy source with a secondary wall and a first wall containing a porous section.

Yet another example embodiment of wall 42 of first passage 40 and acoustic energy source 20 is shown in FIG. 5, where acoustic energy source 20 is not in direct contact with wall 42. Instead, secondary wall 45 exists on which plurality acoustic energy sources 20 are mounted. Wall 40 consists plurality of porous sections 95. Space 46 between wall 42 and secondary wall 45 can be at ambient air pressure. It can also be kept to have an air pressure lower or higher than that of passage 40. When the pressure in space 46 is higher than that in passage 40, air will enter into passage 40 from space 46. When the pressure in space 46 is lower than that in passage 40, air will leak into space 46 from passage 40.

The example embodiment shown in FIG. 5 can also be extended to include a wall with travel path. The concept of printing system with a wall or web traveling along a path has been described in, for example, commonly assigned U.S. patent application Ser. Nos. 11/746,117; 11/746,104; 11/746,094, the disclosures of which are incorporated by reference herein. According to one aspect of that invention, a printing system includes a liquid drop ejector operable to eject liquid drops having a plurality of volumes along a first path and a passage for a fluid including a wall. A fluid flow source is operable to cause the fluid to flow in a direction through the passage. The wall of the passage has a travel path with the travel path of the wall being in the same direction as that of the fluid flow. Interaction of the fluid flow and the liquid drops causes liquids drops having one of the plurality of volumes to begin moving along a second path. In FIG. 5, wall 42 is considered to be a wall with a travel path. It moves along the same direction as the fluid flow 16. In this case, porous section 95 can be replaced by openings or solid wall.

According to embodiments of the present invention, the porous section 95 may be formed from various types of material including, but not limited to, woven fabrics, nonwoven fabrics, combinations of woven and nonwoven fabrics, and polymer foams. The porous section 95 may include a metallic mesh. Moreover, the porous section 95 may include a combination of metallic mesh and fabric (e.g., woven fabric, nonwoven fabric, combinations of woven and nonwoven fabric, etc.). The fabric can be chosen to optimize desired properties, such as airflow rate and acoustic wave transmission, etc. Porous section 95 may consist polymer foam made from alkenyl aromatic resins, such as polystyrenic resin(s), and polyesters such as polyethylene terephthalates. The term "alkenyl aromatic polymer" includes polymers of aromatic hydrocarbon molecules that contain an aryl group joined to an olefinic group with only double bonds in the linear structure. The polymeric foam may also be made from polyolefinic resins such as LDPEs, HDPEs, LLDPEs, and the like. The polymeric foam is preferably made from a polystyrenic resin (s), such as a general purpose polystyrene, because of economical considerations at the present time. The polymeric foam, however, may be made from other polystyrenic resins such as impact polystyrenes. The impact polystyrenes that are generally used include medium impact polystyrenes and high impact polystyrenes. The polymeric foam may also be made from a combination of virgin and/or reprocessed material.

The invention has been described in detail with particular reference to certain example embodiments thereof, but it will be understood that variations and modifications can be effected within the scope of the invention.

PARTS LIST

10 printing system
16 fluid flow
16 arrows
20 acoustic energy source
20 plurality acoustic energy sources
30 printhead
31 drop forming mechanism
32 drops
33 second path
34 third path
35 passage
36 receiver
38 catcher
40 passage
40 wall
42 wall
45 secondary wall
46 space
50 power supply
55 acoustic sound generator
60 band filter
65 amplifier
70 sound level gauge
80 inlet portion
85 outlet portion
90 opening
95 porous section

The invention claimed is:

1. A printing system comprising:

a liquid drop ejector operable to form liquid drops having a plurality of volumes moving along a first path;

a fluid passage including a wall;

a source of acoustic energy associated with the wall; and a fluid flow source associated with the passage, the fluid flow source being configured to provide a fluid flow through the passage, wherein interaction of the fluid flow and the liquid drops causes liquids drops having one of the plurality of volumes to begin moving along a second path.

2. The system of claim 1, the wall including an opening, wherein the source of acoustic energy is positioned adjacent to the opening.

3. The system of claim 2, the opening including a porous material, the porous material being more porous than that of the wall.

4. The system of claim 2, wherein the source of acoustic energy is affixed to the wall.

5. The system of claim 2, the fluid passage including the wall being a first fluid passage, the source of acoustic energy being positioned spaced apart from the wall of the first fluid passage, the system further comprising:

a second fluid passage positioned between the first fluid passage and the source of acoustic energy, the second fluid passage being in fluid communication with the first fluid passage through the opening of the first fluid passage, the second fluid passage including an operating pressure that is different than that of the first fluid passage.

6. The system of claim 5, wherein the operating pressure of the second fluid passage is lower than that of the first fluid passage.

7. The system of claim 5, wherein the operating pressure of the second fluid passage is higher than that of the first fluid passage.

8. The system of claim 1, the wall of the fluid passage including a moveable wall portion and a stationary wall portion, wherein the source of acoustic energy is associated with the stationary wall portion.

9. The system of claim 8, wherein the moveable wall portion is one of a solid wall, a liquid wall, and a gas flow wall.

10. The system of claim 1, wherein the source of acoustic energy is affixed to the wall.

11. A method of printing comprising:

forming liquid drops having a plurality of volumes moving along a first path using a liquid drop ejector;

causing a fluid to flow through the fluid passage using a fluid flow source associated with the passage; and providing acoustic energy to the fluid flow using a source of acoustic energy associated with a wall of the fluid passage, wherein interaction of the fluid flow and the liquid drops causes liquids drops having one of the plurality of volumes to begin moving along a second path.

12. The method of claim 11, wherein providing acoustic energy to the fluid flow includes providing acoustic energy to the fluid flow through an opening in the wall of the fluid passage.

13. The method of claim 11, wherein providing acoustic energy to the fluid flow includes providing acoustic energy to the fluid flow through a porous material portion of the wall of the fluid passage.

14. The method of claim 11, the wall of the fluid passage including a moveable wall portion and a stationary wall portion, the method further comprising:

moving the moveable wall portion while the fluid is flowing through the fluid passage; and providing acoustic energy to the fluid flow through the stationary wall portion.

* * * * *